US005100738A

United States Patent [19]

Graf

[11] Patent Number: 5,100,738

[45] Date of Patent: Mar. 31, 1992

[54] REINFORCED CONCRETE CONTAINING COATED STEEL REINFORCING MEMBER

[75] Inventor: Helmut Graf, Regensburg, Fed. Rep. of Germany

[73] Assignee: Rebar Couplerbox, Inc., Humble, Tex.

[21] Appl. No.: 552,145

[22] Filed: Jul. 12, 1990

[51] Int. Cl.[5] ..... B32B 13/06

[52] U.S. Cl. ..... 428/613; 428/626; 428/653

[58] Field of Search ..... 428/621, 624, 626, 653, 428/684, 613

[56] References Cited

U.S. PATENT DOCUMENTS

| | | | |
|---|---|---|---|
| 3,932,144 | 1/1976 | Matsubara et al. | 428/626 |
| 4,177,323 | 12/1979 | Obi et al. | 428/626 |
| 4,264,684 | 4/1981 | Allegra et al. | 428/653 |
| 4,722,871 | 2/1988 | Radtke | 428/653 |
| 4,950,552 | 8/1990 | Amend et al. | 428/626 |

*Primary Examiner*—Upendra Roy
*Assistant Examiner*—George Wyszomierski
*Attorney, Agent, or Firm*—Lucas & Just

[57] ABSTRACT

The reinforcing steel has a protective coating formed from a first layer of synthetic material and a second layer of aluminum or aluminum alloy between the first layer and the outer surface of the reinforcing steel.

8 Claims, 1 Drawing Sheet

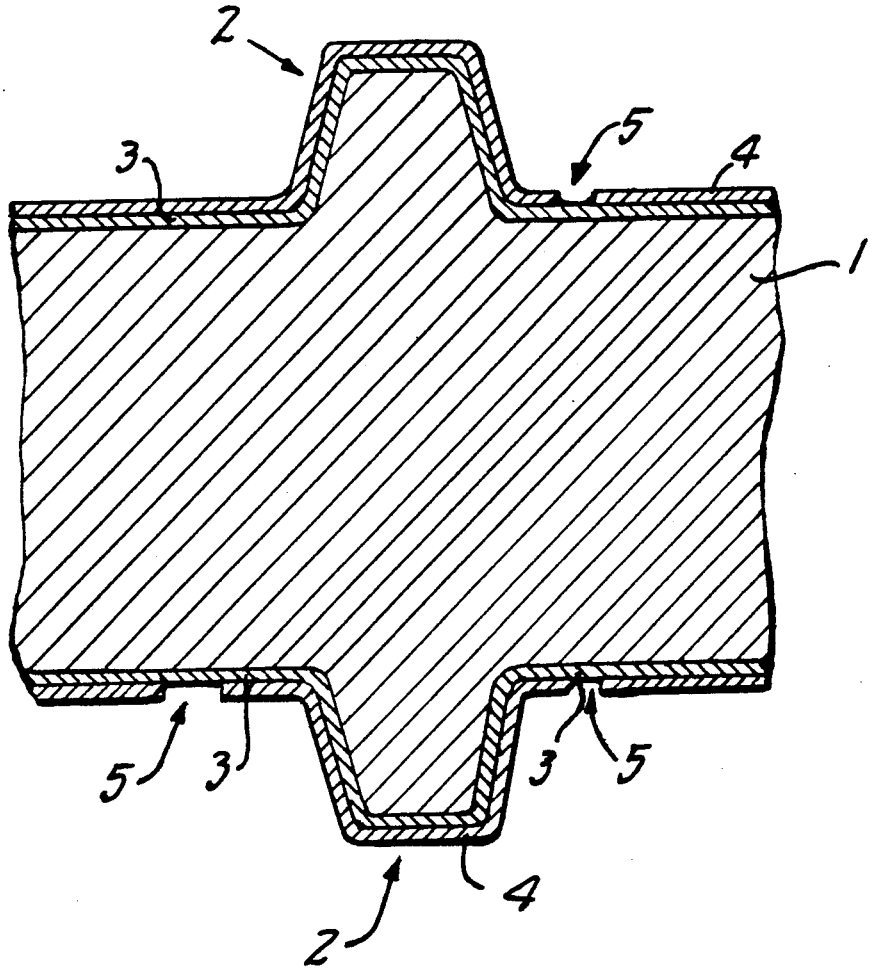
2
3
5
4
1
5
3
3
5
4
2

REINFORCED CONCRETE CONTAINING COATED STEEL REINFORCING MEMBER

This invention relates to a reinforcing steel having a coating thereon to protect against erosion.

A reinforcing steel of this type is known wherein the anticorrosive layer is a layer of synthetic material or of epoxy resins. Reinforcing steels are used for making the iron or steel reinforcement in structural parts of concrete. Corrosion, particularly including corrosion of reinforcing steel imbedded in the concrete of a finished concrete structural part, is a major problem. The object of the invention is to procure a reinforcing steel which eliminates this problem.

To accomplish this object, the reinforcing steel of the present invention is characterized in that a second layer of aluminum or an aluminum alloy is provided between the anticorrosive first layer and the outer surface of the reinforced steel.

In the reinforcing steel of the present invention, the second layer of aluminum or of aluminum alloy ensures reliable corrosion protection, in particular even when cracks appear in the first layer when in use, i.e. in particular upon bending of the reinforcing steel. In such cracks the second layer of aluminum or of aluminum alloy is exposed so that, until the concrete of a concrete structural part in which the reinforcing steel is imbedded sets, this layer then reacts with the free lime of the concrete of the cement with the assistance of oxygen to form a calcium aluminate, which ensures particularly solid and tight fusion with the reinforcing steel, so that no cracks, etc. into which moisture can penetrate occur or remain between the reinforcing steel and concrete. The first layer protects the second layer against external stresses of a chemical and/or mechanical nature.

In accordance with the present invention, the reinforcing steel is characterized in that the thickness of the second layer (3) lies under 200 micrometers. Preferably, the thickness of the second layer lies in the order of magnitude of about 20 to 25 micrometers.

The reinforcing steel of the present invention is further characterized in that the aluminum alloy forming the second layer contains zinc, while the percentage of aluminum is greater than 50% and, preferably, between about 55% and 70%.

Further, the second layer is characterized in that the percentage of zinc is smaller than 50% and, preferably, between about 28% and 43%.

It is preferred that the first layer be a layer of synthetic material, preferably a layer of epoxy resin.

The invention is described in detail below and may be further understood by reference to the accompanying drawing wherein a length of reinforcing steel pursuant to the invention is shown in schematic representation and in longitudinal section.

The reinforcing steel 1, of which only a very short length is represented in the figure, consists of a steel alloy customary in reinforcing steels and is additionally provided on its outer surface with the profiling customary in reinforcing steels, which in the embodiment shown is formed of ribs 2 produced by rolling of the reinforcing steel 1.

Immediately after rolling of the reinforcing steel 1, a layer 3 of aluminum or of an aluminum alloy, preferably of an aluminum-zinc alloy, is applied thereon. The layer 3 covers the reinforcing steel 1 on its entire outer surface, specifically including the region of the ribs 2. On the layer 3 there is applied a layer 4 of synthetic material, preferably of epoxy resin, which completely covers the layer 3, i.e. likewise extends over the entire length and the entire circumference of the reinforcing steel 1. The layer 4 is preferably likewise applied on the still hot reinforcing steel 1 so that a very intimate joint is produced between this layer and the layer 3.

If the layer 3 consists of an aluminum-zinc alloy, this layer preferably contains more than 50%, for example about 55%, by weight aluminum; less than 50%, for example about 43%, by weight zinc; as well as a small portion of silicon, for example about 2% by weight silicon.

In a preferred embodiment, the thickness of the layer 3 is selected so that, after reaction with the free lime of the concrete and with oxygen to form calcium aluminate, at the region 5 concerned, only an extremely small residual thickness remains for the layer 3, the residual thickness ensuring tight fusion with the concrete. The thickness of the layer 3 lies under 200 micrometers, preferably around between 20 and 25 micrometers.

The two layers 3 and 4 produce optimal corrosion protection for the reinforcing steel 1 before its use and/or during its storage but, above all, optimal corrosion protection as well for the reinforcing steel imbedded in concrete.

When the reinforcing steel 1 is stored before use, the layer 4 supplies sufficient corrosion protection. When the reinforcing steel 1 is used, it is customarily bent in at least several regions for making a reinforcement, specifically in such fashion that the final structural part of concrete the shape of steel reinforcement required for the dynamic and/or static load is obtained. During this bending cracks appear in the layer 4 so that in the region of such cracks the layer 3 is not covered by the material of the layer 4, but is exposed, as indicated in the figure, with the cracks or regions 5. If such a reinforcing steel is imbedded in concrete when a concrete structural part is made, the aluminum of the layer 3 reacts at the cracks or regions 5 with the free lime of the concrete or the cement and with oxygen to form a calcium aluminate, which ensures particularly solid and, above all, tight fusion of the reinforcing steel in the concrete of the concrete structural part so that, even at bent sections of the reinforcing steel 1 and/or at cracks produced there in the layer 4, no corrosion of the reinforcing steel can appear in the finished concrete structural part.

The layer 4 of synthetic material is likewise necessary to protect the layer 3 before imbedding of the reinforcing steel 1 in concrete, i.e. upon its storage, etc., against external mechanical and chemical actions and to prevent the effect of the layer 3 from being lost due to such external influences.

What is claimed is:

1. A steel reinforcing member in a structural part of concrete comprising a ;reinforcing steel, the reinforcing steel having a first layer of synthetic material forming a protection against corrosion and a second layer of aluminum or aluminum alloy, the second layer being between the first layer and the outer surface of the reinforcing steel, the reinforcing steel having been bent and, after bending, imbedded in concrete thereby forming the structural part of concrete, the reinforcing member having cracks in the first layer caused by the bending, wherein, after imbedding, the aluminum of the second layer in the region of the cracks reacts with the free lime of the concrete or the cement of the concrete and with oxygen to form a calcium aluminate such that a solid and tight fusion of the reinforcing steel with the concrete of the structural part of concrete is obtained.

2. The reinforcing steel of claim 1 wherein the thickness of the second layer under 200 micrometers.

3. The reinforcing steel of claim 2 wherein the thickness of the second layer is in the order of magnitude of about 20 to 25 micrometers.

4. The reinforcing steel of claim 1 wherein the aluminum alloy forming the second layer contains zinc, while the percentage of aluminum is greater than 50%.

5. The reinforcing steel of claim 4 wherein the percentage of aluminum is between about 55% and 70%.

6. The reinforcing steel of claim 4 wherein the percentage of zinc is smaller than 50%.

7. The reinforcing steel of claim 6 wherein the percentage of zinc is between about 28% and 43%.

8. The reinforcing steel of claim 1 wherein the synthetic material is an epoxy resin.

* * * * *

UNITED STATES PATENT AND TRADEMARK OFFICE

CERTIFICATE OF CORRECTION

PATENT NO. : 5,100,738

DATED : March 31, 1992

INVENTOR(S) : Helmut Graf

It is certified that error appears in the above-identified patent and that said Letters Patent is hereby corrected as shown below:

Column 2, line 56, after "a" delete ";".

Column 3, line 4, after "layer" insert --is--.

Signed and Sealed this

Eighth Day of June, 1993

*Attest:*

Michael K. Kirk

MICHAEL K. KIRK

*Attesting Officer*

*Acting Commissioner of Patents and Trademarks*